US009102069B2

(12) United States Patent
Shimizu et al.

(10) Patent No.: US 9,102,069 B2
(45) Date of Patent: Aug. 11, 2015

(54) HAIR REMOVER

(71) Applicant: Panasonic Corporation, Kadoma-shi, Osaka (JP)

(72) Inventors: Hiroaki Shimizu, Shiga (JP); Tetsuro Hashiguchi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 213 days.

(21) Appl. No.: 13/626,669

(22) Filed: Sep. 25, 2012

(65) Prior Publication Data

US 2013/0091709 A1 Apr. 18, 2013

(30) Foreign Application Priority Data

Oct. 14, 2011 (JP) ..... 2011-226953

(51) Int. Cl.
*B26B 19/02* (2006.01)
*B26B 19/04* (2006.01)

(52) U.S. Cl.
CPC ..... *B26B 19/048* (2013.01); *B26B 19/02* (2013.01)

(58) Field of Classification Search
CPC ..... B26B 19/00; B26B 19/06; B26B 19/063; B26B 19/048; B26B 19/02
USPC ..... 30/43.1, 43.3, 54, 58, 60, 61, 63, 71, 30/526–541, 43.7–43.92, 198, 199
See application file for complete search history.

(56) References Cited

U.S. PATENT DOCUMENTS

| | | | | | |
|---|---|---|---|---|---|
| 511,966 | A | * | 1/1894 | Olsen | 30/199 |
| 831,259 | A | * | 9/1906 | Bingler | 30/531 |
| 1,427,587 | A | * | 8/1922 | Fugitt | 30/199 |
| 1,552,234 | A | * | 9/1925 | Roebuck | 30/529 |
| 1,997,096 | A | * | 4/1935 | Andis | 30/199 |
| 2,113,772 | A | * | 4/1938 | Rothschild et al. | 30/48 |
| 2,162,388 | A | * | 6/1939 | Rockwell | 30/531 |
| 2,484,610 | A | * | 10/1949 | Cromonic | 30/210 |
| 3,797,109 | A | * | 3/1974 | Yamada et al. | 30/531 |
| 3,964,160 | A | * | 6/1976 | Gordon | 30/531 |
| 4,083,103 | A | * | 4/1978 | Estandian | 30/531 |
| 4,332,321 | A | * | 6/1982 | Wratschko | 30/536 |
| 4,837,930 | A | * | 6/1989 | Righi | 30/535 |
| 4,841,635 | A | * | 6/1989 | Maurizi et al. | 30/535 |

(Continued)

FOREIGN PATENT DOCUMENTS

| | | | |
|---|---|---|---|
| JP | 2001-246183 | A | 9/2001 |
| JP | 2002-369979 | A | 12/2002 |
| JP | 2008-229263 | A | 10/2008 |

*Primary Examiner* — Jason Daniel Prone
(74) *Attorney, Agent, or Firm* — McDermott Will & Emery LLP

(57) ABSTRACT

A hair remover including: a main unit having a gripper, a head unit having a blade for removing body hair, and a drive unit for driving the blade. The main unit is provided, in one end thereof, with an extension portion that supports the head unit. The extension portion extends in one direction, referred to as an extending direction, from the one end on the main unit. The hair remover is configured to switch between a first state where a longitudinal direction of the head unit is parallel to the extension direction and a second state where the longitudinal direction of the head unit is perpendicular to the extension direction. The hair remover is configured so that an outer periphery of the head unit is located so as to be flush with or is located within an outer periphery of said the main unit when viewed from the extension direction.

6 Claims, 14 Drawing Sheets

(56) References Cited

U.S. PATENT DOCUMENTS

| | | | | | |
|---|---|---|---|---|---|
| 4,977,669 | A * | 12/1990 | Clifford | 30/539 |
| 5,010,645 | A * | 4/1991 | Furukawa | 30/47 |
| 5,070,614 | A * | 12/1991 | Hardin et al. | 30/527 |
| 5,093,991 | A * | 3/1992 | Hendrickson | 30/531 |
| 5,165,172 | A * | 11/1992 | Weinrauch | 30/199 |
| 5,206,994 | A * | 5/1993 | Lin | 30/536 |
| 5,269,062 | A * | 12/1993 | Dallaire et al. | 30/539 |
| 5,465,488 | A * | 11/1995 | Yaw et al. | 30/535 |
| 5,526,568 | A * | 6/1996 | Copelan | 30/531 |
| 5,622,195 | A * | 4/1997 | Lee | 30/535 |
| 5,784,785 | A * | 7/1998 | Polites | 30/528 |
| 6,151,785 | A * | 11/2000 | Morris | 30/206 |
| 6,502,312 | B2 * | 1/2003 | Beutel et al. | 30/216 |
| 6,536,116 | B2 * | 3/2003 | Fung | 30/199 |
| 6,684,507 | B2 * | 2/2004 | Lau et al. | 30/216 |
| 7,140,116 | B2 * | 11/2006 | Coffin | 30/531 |
| 7,251,896 | B2 * | 8/2007 | Khubani | 30/199 |
| 7,503,118 | B2 * | 3/2009 | Oh | 30/43.1 |
| 7,721,451 | B2 * | 5/2010 | Psimadas et al. | 30/527 |
| 7,805,846 | B2 * | 10/2010 | Leventhal et al. | 30/526 |
| 8,127,453 | B2 * | 3/2012 | Haczek et al. | 30/527 |
| 8,359,755 | B1 * | 1/2013 | Laube | 30/199 |
| 8,595,938 | B2 * | 12/2013 | Bodet | 30/527 |
| 2008/0155834 | A1 * | 7/2008 | Li et al. | 30/199 |
| 2008/0295340 | A1 * | 12/2008 | Carlucci et al. | 30/199 |
| 2008/0301948 | A1 * | 12/2008 | Kostner et al. | 30/527 |
| 2009/0056148 | A1 * | 3/2009 | Royle | 30/277.4 |
| 2011/0203112 | A1 * | 8/2011 | Lax | 30/541 |
| 2011/0277326 | A1 * | 11/2011 | Bodet | 30/527 |
| 2012/0291295 | A1 * | 11/2012 | Braun | 30/531 |
| 2013/0081277 | A1 * | 4/2013 | Shimizu et al. | 30/42 |
| 2013/0081278 | A1 * | 4/2013 | Shimizu et al. | 30/45 |
| 2013/0247394 | A1 * | 9/2013 | Reid et al. | 30/532 |

* cited by examiner

A

B

A

B

A

B

HAIR REMOVER

TECHNICAL FIELD

The invention relates to a hair remover configured to drive a blade to cut body hair.

BACKGROUND ART

There used to be a hair remover which includes a comb-shaped fixed blade and a comb-shaped movable blade. This hair remover includes a head unit having the fixed blade and the movable blade, and a main unit having an extension portion provided at one end of its gripper. The head unit is arranged at the tip of the extension portion. When contacting the head unit with a haired biological surface and then introducing the body hair between the fixed and movable blades, the introduced body hair is sheared (cut off) with the fixed and movable blades. The hair remover thereby cuts to remove the body hair on the biological surface. For instance, Japanese Patent Application Laid-Open No. 2002-369979 discloses one of such a hair remover in which comb-shaped fixed and movable blades are arranged in parallel with an extension direction of the extension portion, and Japanese Patent Application Laid-Open No. 2008-229263 discloses another one of such a hair remover in which comb-shaped fixed and movable blades are arranged in a direction perpendicular to an extension direction of the extension portion.

In this kind of hair remover, when cutting off body hair, the head unit (the fixed and movable blades) contacts with the biological surface in a direction perpendicular to a growing direction of the body hair and then is moved along the growing direction, and thereby the body hair is introduced between these blades.

However, the conventional hair removers, such as those described in the above documents, can remove body hair only in a single posture, that is, one posture where a direction of the head unit is in parallel with the extension direction or the other posture where the direction of the head unit is perpendicular to the extension direction. That is, when body hair is removed by the conventional hair removers, a hair removing direction (which being the direction that the head unit is moved with respect to the biological surface) is always unchanged with respect to the main unit. For this reason, when removing body hair growing on an area having irregularities around, such as a biological surface of a base of arm or leg, the main unit itself or a human-hand grasping the main unit may interfere with the irregularities. As a result, the body hair is not easily introduced between the fixed and movable blades, and there is a possibility that hair growing on such an area is insufficiently shaved.

Besides, it has been an increasing demand for an easily portable cosmetic apparatus in order to arrange the appearance when the user is in an outside. The hair remover also has been desired to be downsized in order to easily carry it.

DISCLOSURE OF INVENTION

The present invention has been developed with considering above problem, and it is an object of the present invention to provide a hair remover, which can reduce the possibility that body hair is insufficiently shaved due to the interference with a body associated with a posture limitation of a head unit, and which is downsized by reducing the protrusion of the head unit.

In order to solve the above problem, the hair remover of the present invention comprising: a main unit having a gripper; a head unit having a blade for removing body hair; and a drive unit for driving said blade, wherein said main unit is provided in one end with an extension portion configured to support said head unit, an extending direction of said extension portion from said one end being defined as an extension direction, wherein said hair remover further comprises a rotating mechanical section configured to rotate said head unit with respect to said main unit around its rotation center, an axial direction of said rotation center of said rotating mechanical section being perpendicular to the extension direction, wherein said head unit has a longitudinal direction and a width direction each crosses with the axial direction of said rotation center of said rotating mechanical section, wherein said rotating mechanical section is configured to switch between a first state where the longitudinal direction of said head unit is parallel to the extension direction and a second state where the longitudinal direction of said head unit is perpendicular to the extension direction, and wherein said hair remover is configured so that outer periphery of said head unit is located so as to be flush with the outer periphery of said main unit or is located within outer periphery of said main unit when viewed from the extension direction.

It is preferred that the hair remover may be configured, wherein said drive unit comprises: a motor as a drive source that is located in said main unit and that has a rotation shaft extending parallel to the extension direction; and a drive transmission unit configured to transfer the rotational driving force of said motor to said head unit in both of said first state and said second state, wherein said drive transmission unit comprises: an output member configured to output the rotational driving force of said motor to said head unit; and a transmission member configured to transfer the rotational driving force to said output member, and wherein said transmission member is located some distance from said rotation shaft, toward the outside along a radial direction of said rotation shaft.

It is preferred that the hair remover may be configured, wherein said drive unit comprises a motor as a drive source that is located in said main unit, wherein said extension portion is located at said one end of said main unit so as to be distant from said rotation shaft, toward the outside along a radial direction of said rotation shaft, and thereby a step is formed between said one end of said main unit and said extension portion so as to form a recess, and wherein said head unit is rotatably arranged at said recess.

It is preferred that the hair remover may be configured that, wherein said transmission member comprises a transmission shaft arranged parallel to the extension direction, and wherein said transmission shaft is located some distance from said rotation shaft of said motor in the radial direction of said rotation shaft.

This configuration makes it possible to perform removing body hair without occurrence of the interference with the body by means of desirably selecting the direction of the head unit (cutting width), so as to reduce the possibility that body hair is insufficiently shaved. As a result, the convenience of the hair remover can be improved. In addition, the hair remover can be downsized by reducing the protrusion of the head unit with respect to the outer periphery of the main unit.

BRIEF DESCRIPTION OF DRAWINGS

FIG. 10A shows an exploded perspective view of the swinging mechanical section, and FIG. 10B shows a perspective view of the swinging mechanical section in a state where a holder is attached to a turn plate;

FIG. 12A shows a cross-section view of the periphery of a supporting platform, and FIG. 12B shows a cross-section view of the periphery of an elastic body;

FIG. 13A shows a schematic side view thereof when the head unit is in the natural state, and FIG. 13B shows a schematic side view thereof when the head unit is in a swinging state;

FIG. 14A shows the embodiment in a first state, and FIG. 14B shows the embodiment in a second state;

FIG. 15A shows a side view thereof, and FIG. 15B shows a view thereof when viewed from an extension direction;

DESCRIPTION OF EMBODIMENTS

An embodiment of the present invention will be explained below referring to attached Figures.

Figure 1:
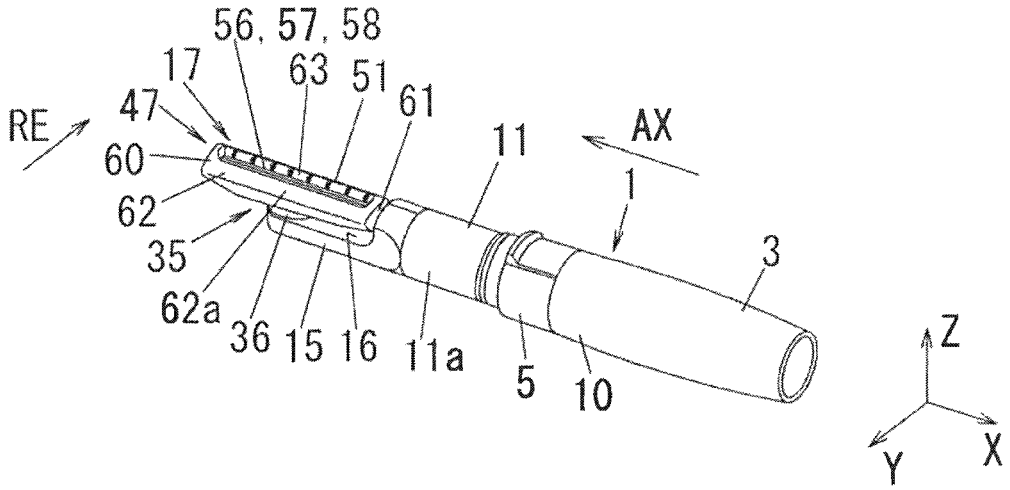
FIG. 1 shows a perspective view of a hair remover according to an Embodiment of the present invention.

As shown in FIG. 1, a hair remover according to the present embodiment includes: a main unit 1 having an electric power source built in; a head unit 47 having a blade 56 for removing hair; a drive unit 20 (see FIG. 5) for driving the head unit 47; and a cap 6 (see FIG. 16) detachably attached to the main unit 1 so as to cover the head unit 47.

Figure 2:
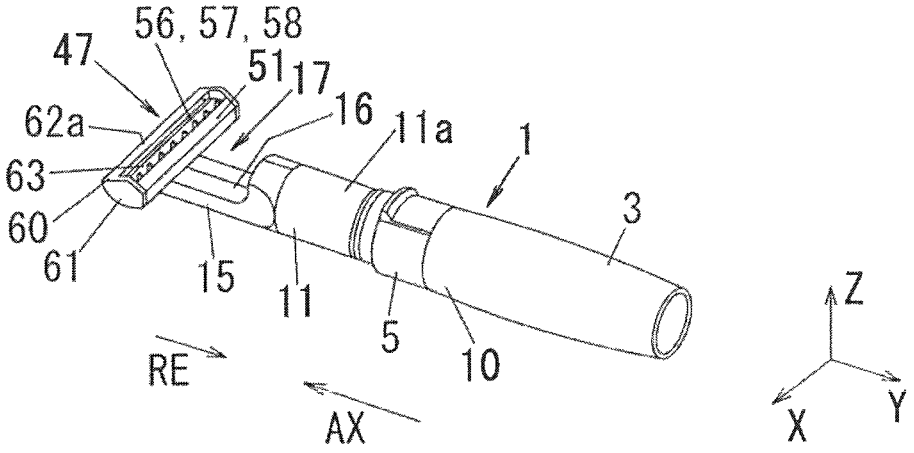
FIG. 2 shows a perspective view of the hair remover according to the Embodiment of the present invention in a state where the direction of a head unit thereof has changed from the FIG. 1.
Figure 4:
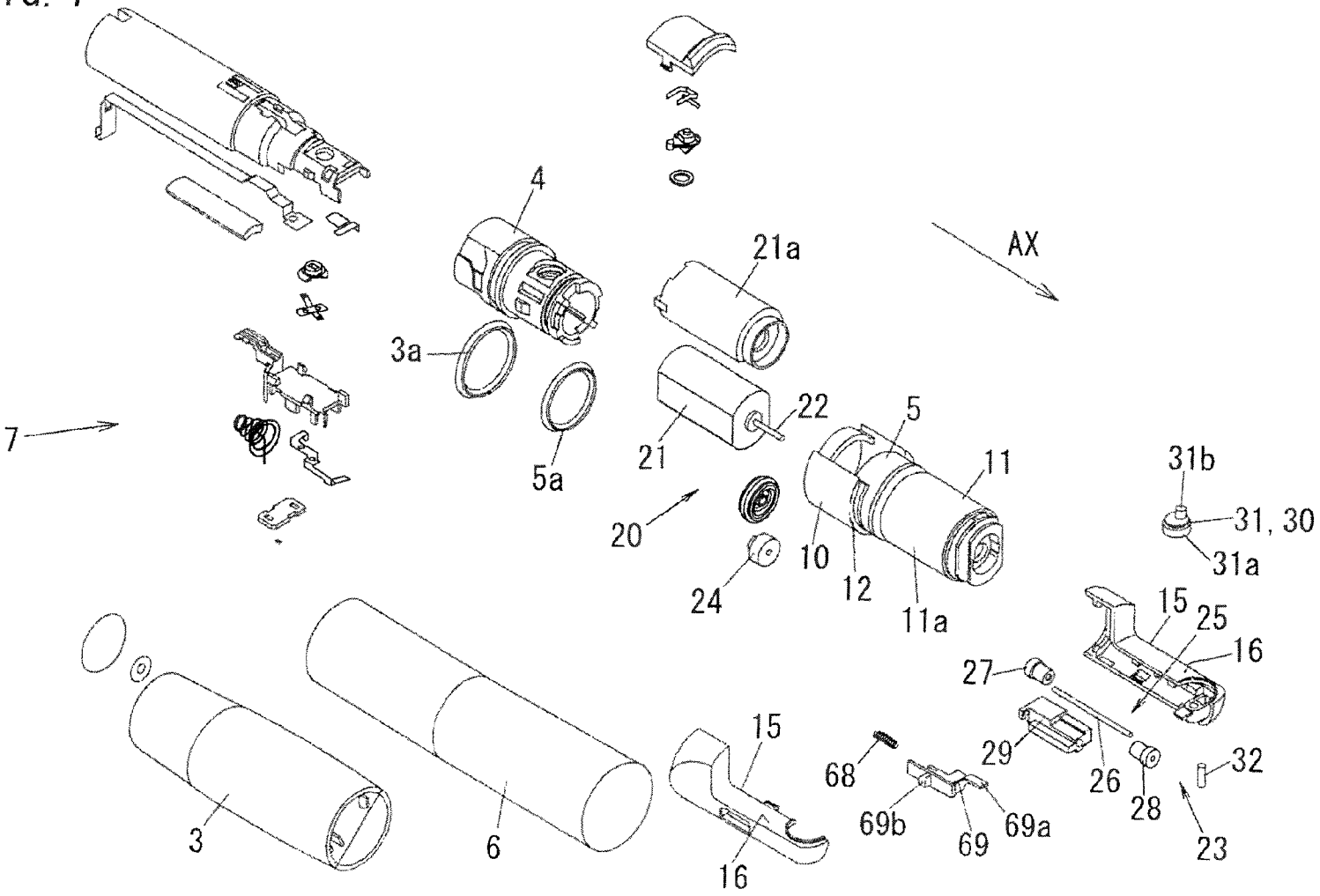
FIG. 4 shows an exploded perspective view of a main unit and a drive unit in the hair remover according to the Embodiment of the present invention.

As shown in FIG. 4, the main unit 1 includes: a power supply portion 7 configured to be equipped with a battery cell (not shown) of an electric source; a housing 5 in which the drive unit 20 is housed; a seal holder 4 for coupling the housing 5 and the power supply portion 7; and a battery cover 3 for replacing the battery cell. The battery cover 3 is detachably attached to the seal holder 4 so as to cover to conceal the power supply portion 7. Then, a casing of the main unit 1 is formed into a hollow cylinder shape through the housing 5 and the battery cover 3. The casing of the main unit 1 is composed of a gripper 10 which an outer periphery thereof can be grasped by a user when using the hair remover, and a small diameter section 11 which has a smaller diameter than the gripper 10 (see FIG. 1). As shown in FIGS. 1 and 2, the gripper 10 and the small diameter section 11 are continuously formed in an axial direction so that axes thereof substantially correspond with each other. Then, as shown in FIGS. 4 and 15A, a difference 12 in level is provided between the gripper 10 and the small diameter section 11. Then, the housing 5 is attached to the seal holder 4 through an O-ring 5*a*, and the battery cover 3 is attached to the seal holder 4 through an O-ring 3*a*. Thereby, the main unit 1 is made to have a waterproof structure in its inside.

Figure 5:
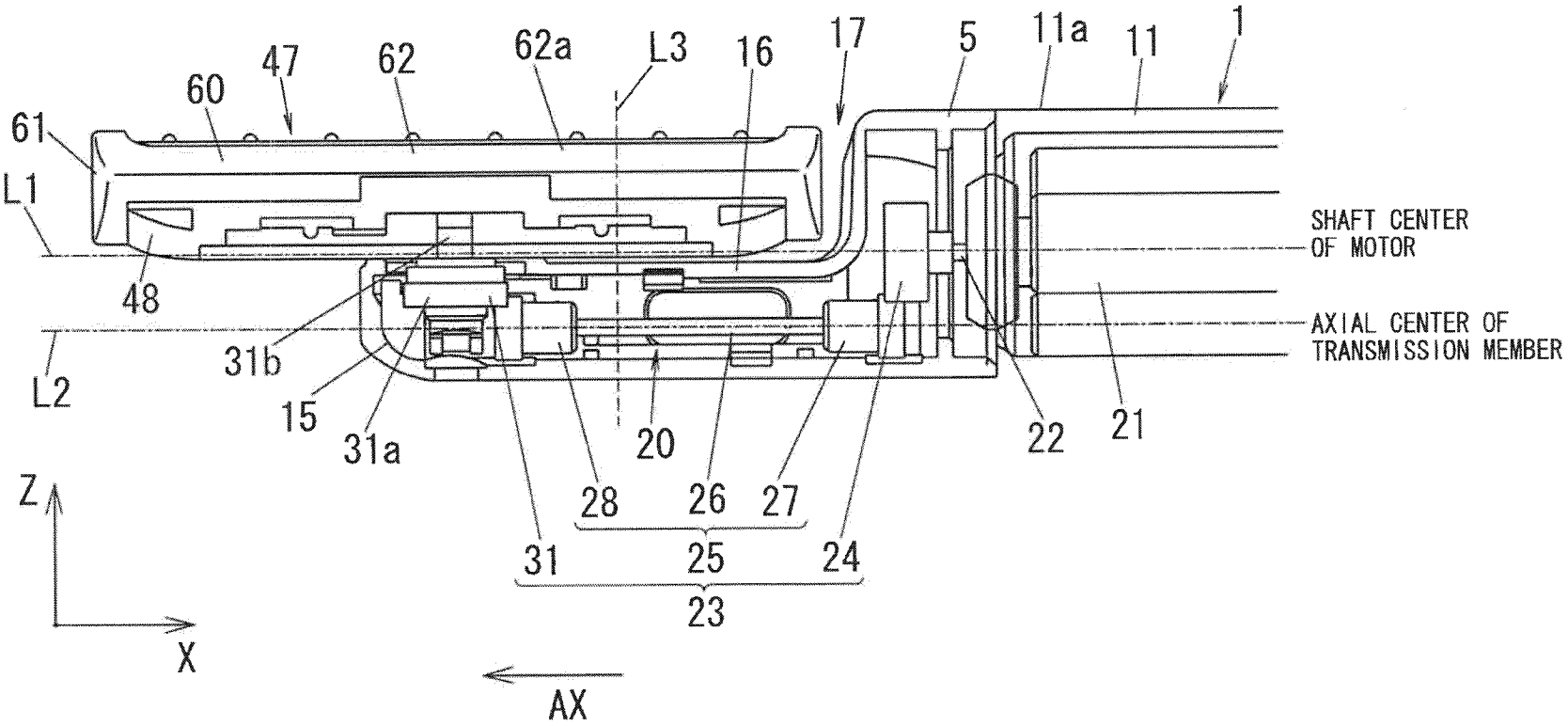
FIG. 5 shows a side view of an extension portion and its periphery in the hair remover according to the Embodiment of the present invention, and partially includes a transparent view.

Furthermore, as shown in FIGS. 4 and 5, the small diameter section 11 is formed as a part of the housing 5. A motor housing 21*a* is located in the inside of the small diameter section 11, in a state where a driving source (a motor 21) of the drive unit 20 is stored in the motor housing 21*a* (see FIG. 4). As shown in FIGS. 1 and 2, an extension portion 15 is provided at one end in an axial direction of the main unit 1 (the small diameter section 11 side of the main unit 1). The extension portion 15 extends along the axial direction of the main unit 1. Hereinafter, unless otherwise noted, an extending direction of the extension portion 15 (the axial direction of the main unit 1) will be described as an extension direction Ax.

Figure 6:
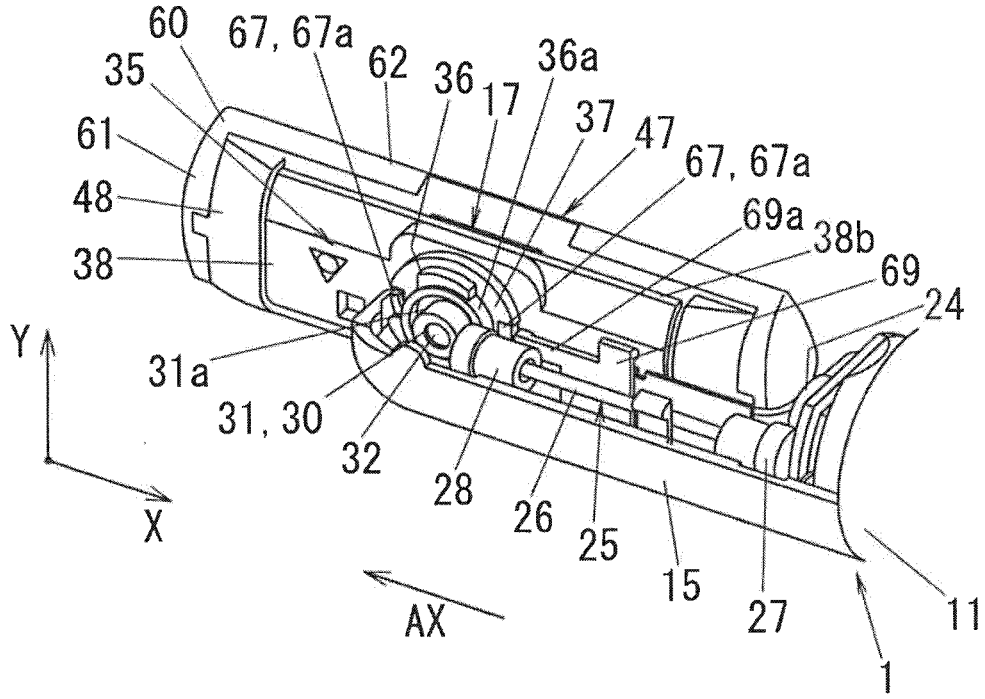
FIG. 6 shows a perspective view of the extension portion and its periphery in the hair remover according to the Embodiment of the present invention, and partially includes a transparent view.

As shown in FIGS. 4 to 6, the drive unit 20 includes the motor 21 as the driving source and a drive transmission unit 23 configured to transfer the driving force of the motor 21 to the head unit 47. The motor 21 has a rotation shaft 22. The motor 21 is located so that the axial direction of the rotation shaft 22 is parallel to the extension direction Ax and corresponds with an axis of the small diameter section 11. The drive transmission unit 23 includes a pinion gear 24 that is attached to the rotation shaft 22, an output member 30 configured to output the driving force into the head unit 47, and a gear block 25 (transmission member) configured to transfer the driving force from the pinion gear 24 to the output member 30. The pinion gear 24 is housed in one end, which is the side of extension portion 15, of the small diameter section 11. The pinion gear 24 is attached to the rotation shaft 22 so that axes thereof substantially correspond with each other.

As shown in FIG. 4, the gear block 25 includes a transmission shaft 26 that is provided in its both ends with gears, and a bush 29 configured to rotatably hold the transmission shaft 26.

As shown in FIGS. 5 and 6, the transmission shaft 26 has a shaft center which is parallel to the rotation shaft 22 and the extension direction Ax. A gear (a first gear 27) provided in one end of the transmission shaft 26 engages with the pinion gear 24, and the opposite gear (a second gear 28) engages with the output member 30. The transmission shaft 26 is arranged in the extension portion 15 in a state where the first gear 27 is located in the side of the small diameter section 11 and where the transmission shaft 26 itself passes through the bush 29. The bush 29 is attached within the extension portion 15, and thereby the transmission shaft 26 is positioned and is held in the extension portion 15.

As shown in FIG. 4, the output member 30 includes a substantially column-shaped face gear 31, and a shaft member 32 that functions as a rotation center of the face gear 31. The shaft member 32 is placed in the extension portion 15 so that its shaft center is substantially perpendicular to the extension direction Ax. The shaft member 32 is fixed to a member forming the extension portion 15 of the housing 5.

Then, the shaft member 32 is inserted to a center of the circular-shaped face gear 31 so that axes thereof substantially correspond with each other, and thereby the face gear 31 can rotate around the axis of the shaft member 32. Therefore, the face gear 31 has a rotation center that is substantially perpendicular to the transmission shaft 26 and the rotation shaft 22 of the motor 21.

Then, as shown in FIGS. 4 and 5, the face gear 31 is provided at its lateral surface with gear teeth 31*a* for engaging with the second gear 28. The driving force is transferred from the transmission shaft 26 to the face gear 31 through the second gear 28. The face gear 31 is provided at the head unit 47 side-surface (upper side surface in FIG. 4) with an eccentric section 31*b*. This eccentric section 31*b* decenters the driving force transferred from the transmission shaft 26, and transfers the driving force to the head unit 47. Note that, the face gear 31 may be configured to have the gear teeth 31*a* on the opposite surface against said head unit 47 side-surface.

As described above, the drive unit 20 converts the rotational driving force of the motor 21 into a force of a perpendicular direction and with an eccentricity, through the output member 30 of the drive transmission unit 23, to output the force into the head unit 47. In the present embodiment, because the drive unit 20 includes the gear block 25, the driving force from the motor 21 is transferred to the head unit 47 at a position (see an imaginary straight line L2 in the figure) shifted toward the outside along a radial direction of the rotation shaft 22 from an imaginary straight line L1 (that passes through the rotation shaft 22 along the extension direction Ax), as shown in FIG. 5.

In the hair remover of the present embodiment, the extension portion 15 is located at some distance from the imaginary straight line L1 that passes through the rotation shaft 22, toward the outside along said radial direction (that is, the extension portion 15 is located at a position shifted from the rotation shaft 22, toward the outside along a radial direction of the rotation shaft 22). Here, as shown in FIG. 5, when considering an imaginary straight line L3 which extending in said radial direction and intersecting with the line L1, the extension portion 15 is located so as to be distant from the line L1, toward one side direction (lower direction side in FIG. 5) along the line L3. As a result, the hair remover of the present embodiment is provided with a recess 17 in the opposite direction side to said one direction side. The head unit 47 is located in the recess 17.

Figure 3:
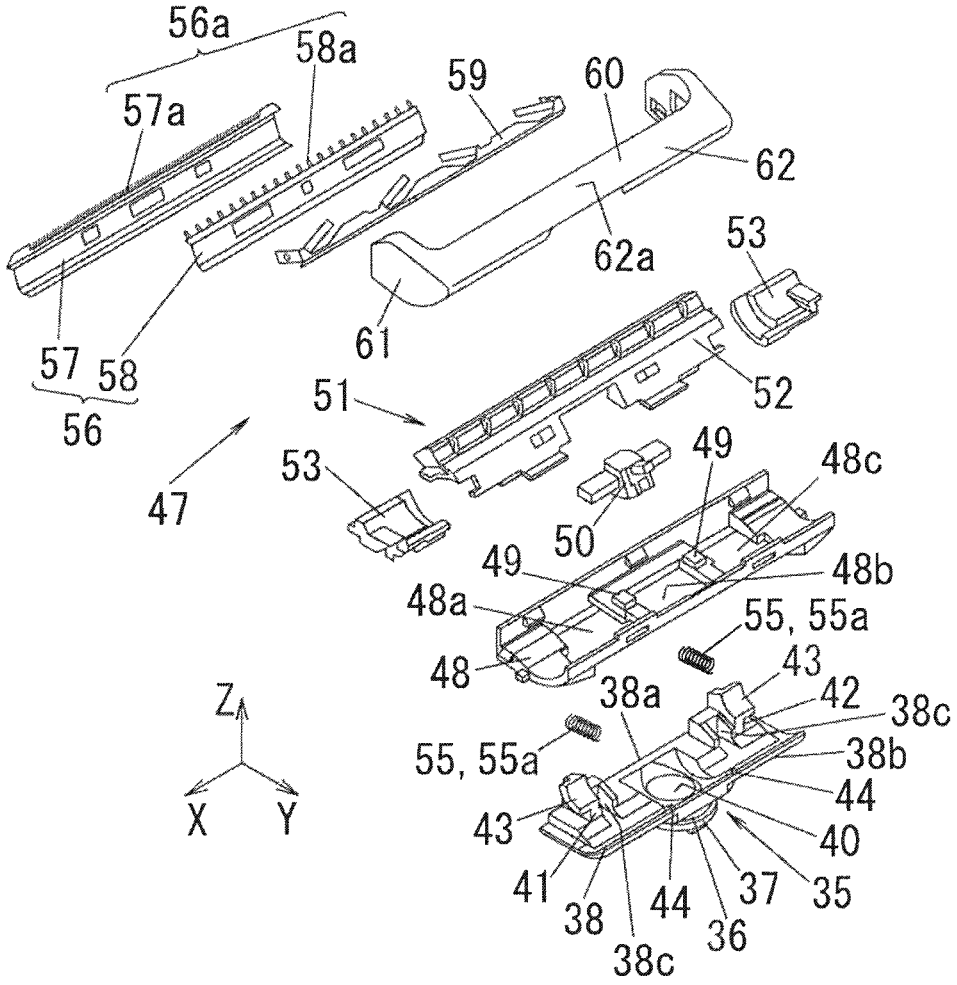
FIG. 3 shows an exploded perspective view of the head unit and a rotating mechanical section in the hair remover according to the Embodiment of the present invention.
Figure 8:
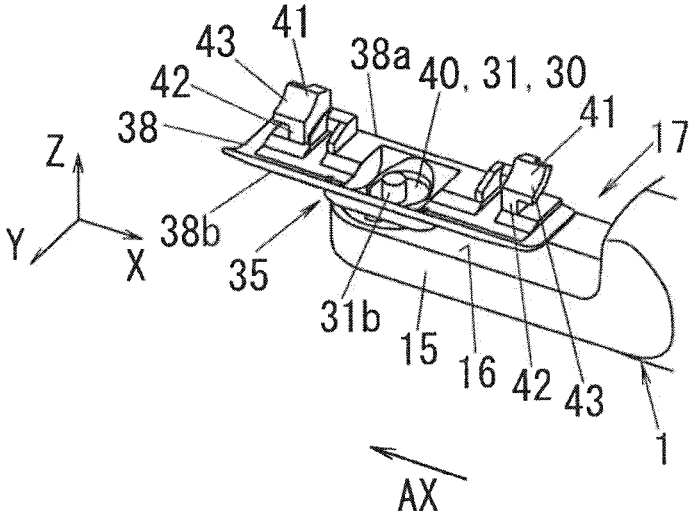
FIG. 8 shows a perspective view of the rotating mechanical section in the hair remover according to the Embodiment of the present invention in a first state.
Figure 9:
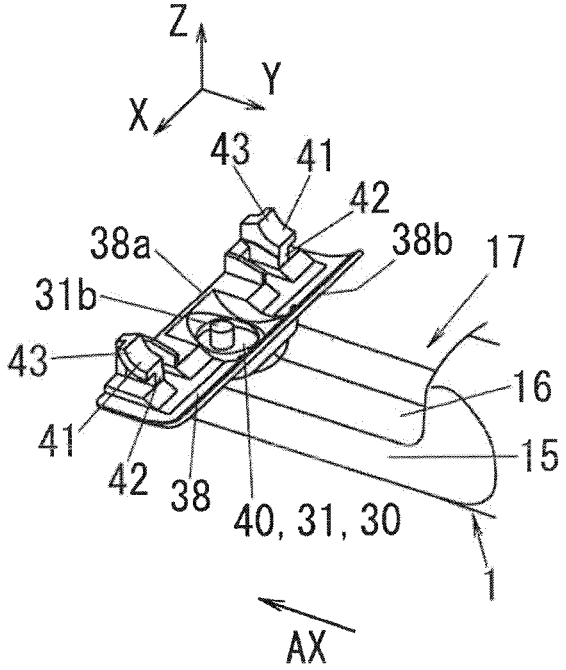
FIG. 9 shows a perspective view of the rotating mechanical section in the hair remover according to the Embodiment of the present invention in a second state.

As shown in FIGS. 8 and 9, the extension portion 15 is provided with a rotating mechanical section 35 configured to rotate the head unit 47 with respect to the main unit 1. Then, as shown in FIG. 6, the extension portion 15 supports the head unit 47 through the rotating mechanical section 35. As shown in FIG. 3, the rotating mechanical section 35 includes a rotating part 36 that is rotatably attached to the extension portion 15, and a turn plate 38 that is integrally provided in the rotating part 36.

Figure 7:
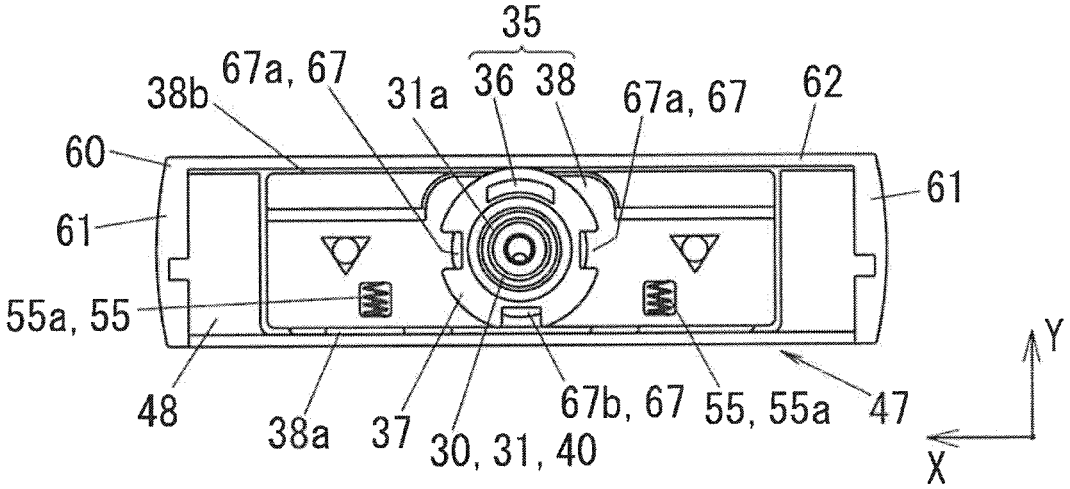
FIG. 7 shows a plain view of the head unit and the rotating mechanical section in the hair remover according to the Embodiment of the present invention.

The rotating part 36 has a hollow cylinder shaped cylinder portion 36*a* and a flange 37 (see FIGS. 6 and 7) that projects outward along the radial direction of the rotating part 36 extending from the intermediate of the height of the cylinder portion 36*a*. As shown in FIGS. 5 and 6, the rotating part 36 is located so that the cylinder portion 36*a* passes through a side wall 16 of the extension portion 15 of the recess 17 side, and the rotating part 36 is rotatably attached near a tip of the extension portion 15. As shown in FIG. 7, the face gear 31 is located in an inner periphery side of the cylinder portion 36*a* so that axes thereof substantially correspond with each other. Then, as shown in FIGS. 6 and 7, the rotating part 36 is arranged so that the flange 37 thereof is positioned in the inside of the extension portion 15. The flange 37 contacts with an inner surface of the side wall 16, and thereby the rotating part 36 is retained in the extension portion 15. Then, one end of the cylinder portion 36*a* of the rotating part 36 is located at the outside of the extension portion 15, and is integrally connected to a first surface (back side in FIG. 8) of the turn plate 38.

The turn plate 38 has a length and a width. Each of the longitudinal direction and the width direction of the turn plate 38 crosses with the axial direction of the rotation center of the rotating mechanical section 35. Hereinafter, a longitudinal direction and a width direction of the turn plate 38 will be described as a longitudinal direction X and a width direction Y, respectively. Also, a direction perpendicular to the plate face of the turn plate 38 (that is, a direction perpendicular to the longitudinal direction X and the width direction Y, respectively) is defined as a thickness direction Z. As shown in FIGS. 7 to 9, the turn plate 38 is formed into a substantially rectangular plate shape in a planar view. The turn plate 38 is provided, in a center of the longitudinal direction X, with a through-hole 40 (see FIG. 3) that communicates into the inner periphery of the cylinder portion 36*a* of the rotating part 36. The through-hole 40 of the turn plate 38 is positioned in the recess 17. Then, the eccentric section 31*b* of the face gear 31 projects into the through-hole 40. That is, the through-hole 40 functions as an output hole 40 for transferring the driving force of the drive transmission unit 23 to the head unit 47 through the eccentric section 31*b*.

Figure 10:
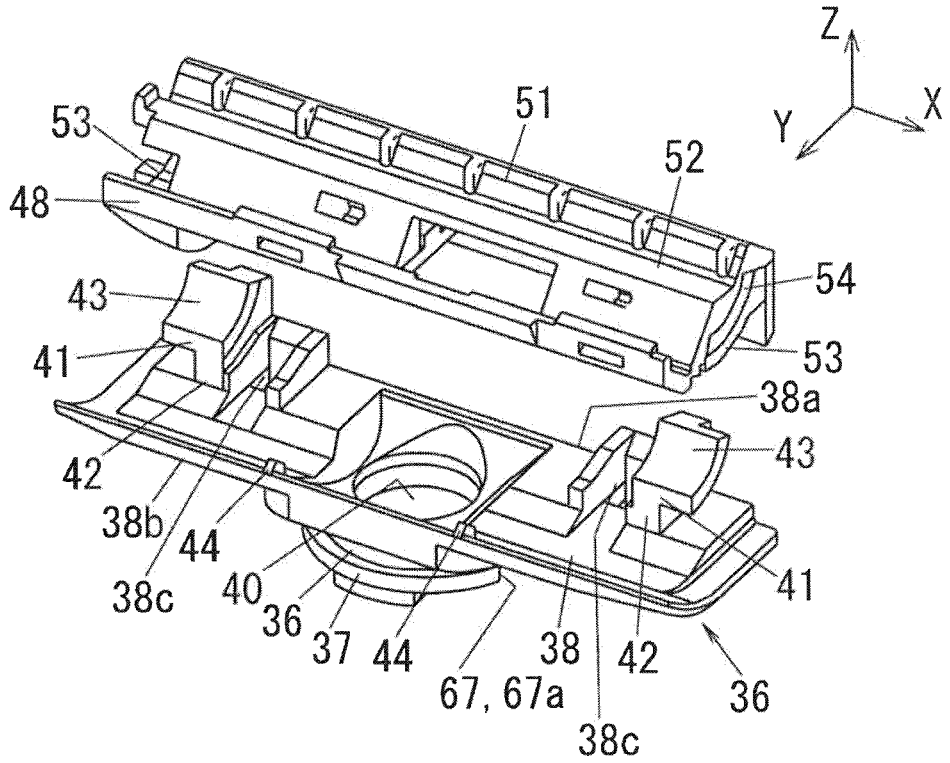
FIG. 10 shows an explanation view of a swinging mechanical section in the hair remover according to the Embodiment of the present invention.
Figure 10:
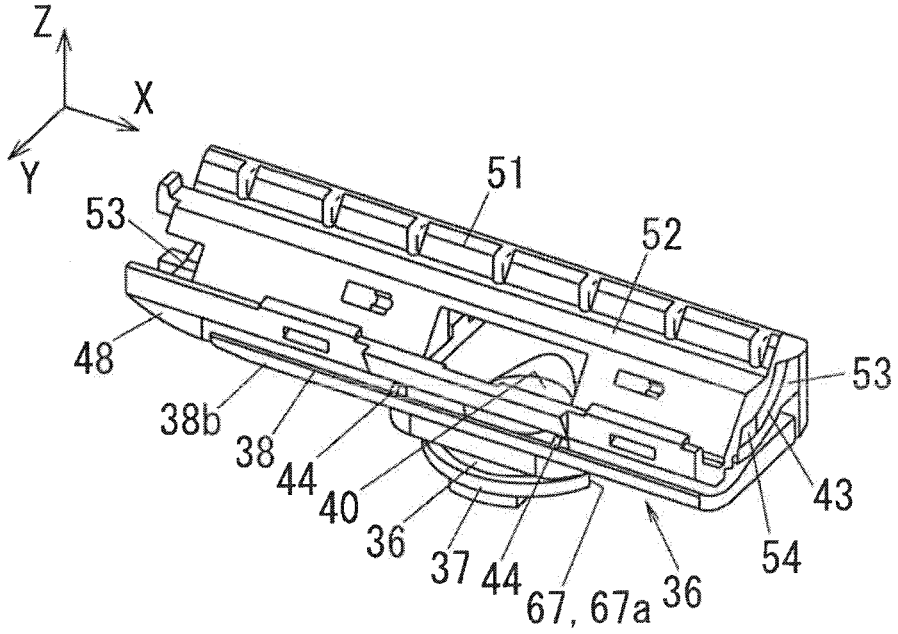

As shown in FIGS. 8 to 10, the turn plate 38 is provided, in a second surface (an opposite surface to the first surface; a front side in FIG. 8), with two supporting platforms 41, 41 configured to support the head unit 47. Each of the supporting platform 41 projects, from the second surface, along the thickness direction Z. Also, in the width direction Y, each of the supporting platform 41 is positioned slightly shifted at some distance from the center of the second surface toward one long side (a first long side 38*a*) of the turn plate 38.

Then, each of the supporting platform 41 has a base portion 42 and an inclined plate 43. The base portion 42 projects from the second surface and is formed into a rectangular shape when viewed from the thickness direction Z. The inclined plate 43 is integrally provided in a tip of the base portion 42 and is formed into a rectangular shape when viewed from the thickness direction Z. In the longitudinal direction X, the inclined plate 43 has a longer size than the base portion 42. The side surfaces of the inclined plate 43 and the base portion 42, facing the longitudinal direction X and located near the output hole 40, are almost flush with each other in the thickness direction Z. Meanwhile, in the opposite side surfaces, the inclined plate 43 projects in the longitudinal direction X more than the base portion 42 (see, for example, FIG. 8).

Then, the inclined plate 43 is formed into an arc shape so as to sag toward the second surface side when viewed from the longitudinal direction X. As shown in FIG. 12A, a center S1 of the arc of the inclined plate 43 is located, at a position distant from the inclined plate 43, on a straight line which extends along the thickness direction Z from a substantial midpoint in the width direction Y of the turn plate 38. In addition, as can be expected from an imaginary circle L4 having a center substantially corresponding with the arc center, the arc intersects with the thickness direction Z and is perpendicular to the longitudinal direction X. In other words, one surface of the inclined plate 43 which is apart from the turn plate 38 (top surface; upper surface of the inclined plate 43 in FIG. 8) is formed as a part of inner side surface of an imaginary cylinder, wherein the center axis of this imaginary cylinder extends parallel to the longitudinal direction X and passes through the imaginary center S1.

In this way, this projecting top surface of each the supporting platform 41 has an inclined surface that is inclined so that the side of the first long side 38*a* is distant from the second surface of the turn plate 38. Then, two of the supporting platforms 41, 41 swingably support the head unit 47 along the inclined surfaces (the arc) of the inclined plates 43, 43. As a result, the head unit 47 is to have an imaginary shaft center S2 of the swing that corresponds with the center S1 of the arc in the inclined plate 43 and extends along the longitudinal direction X. Note that, the shaft center S2 is not a shaft center really existing as a member but an imaginary one, and a shaft member for the shaft center S2 is not provided. Then, the shaft center S2 of the swing crosses with an imaginary straight line (not shown) which extends from the rotation center of the face gear 31 (the center of output hole 40) along the thickness direction Z.

Figure 11:
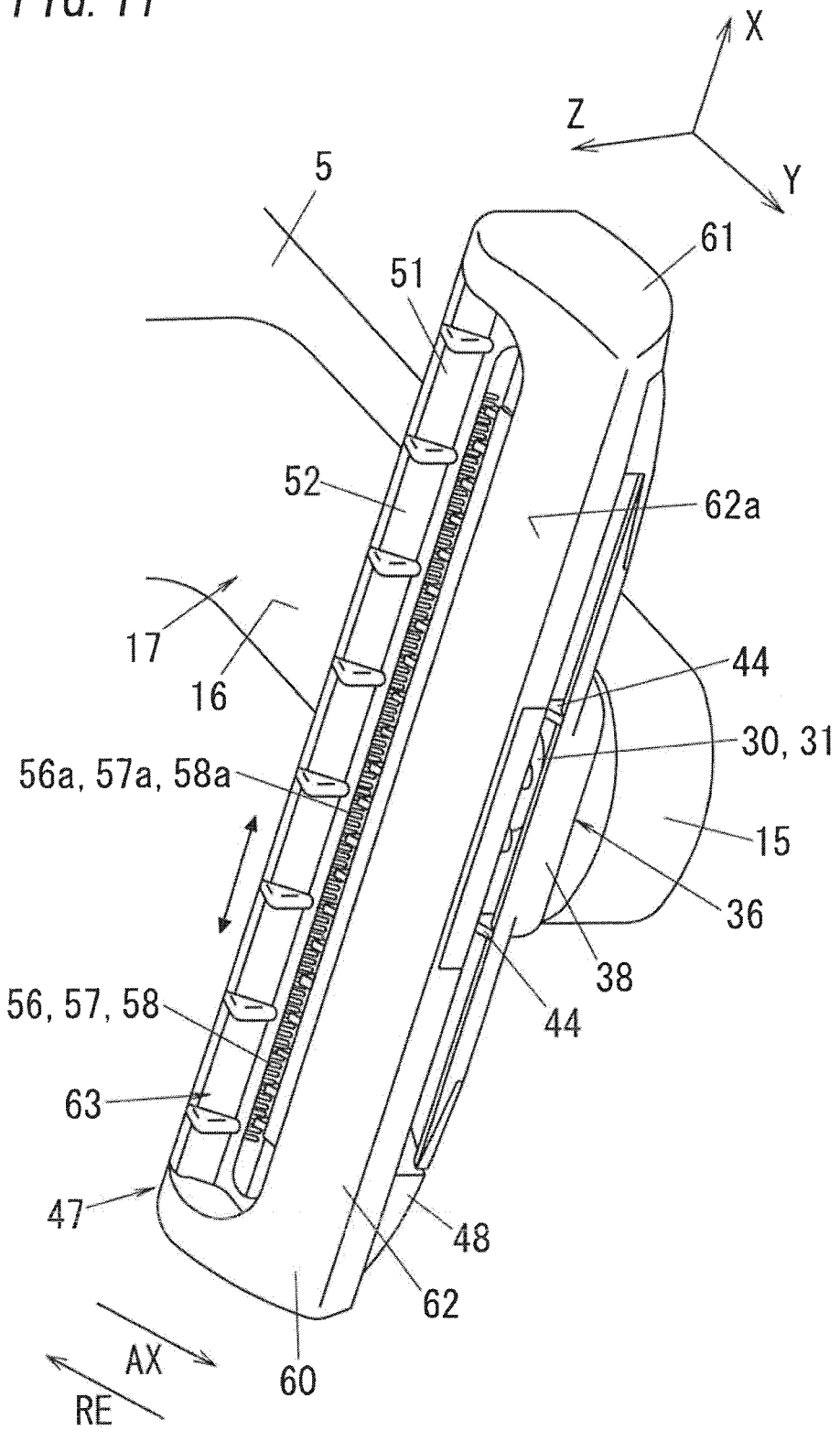
FIG. 11 shows a perspective view of the head unit in the hair remover according to the Embodiment of the present invention.

As shown in FIG. 3, the head unit 47 includes a blade 56 for removing hair, a holder 51, a driving piece 50, a holder cover 48, a blade cover 60 and a force spring 59. As shown in FIG. 11, a casing of the head unit 47 is formed with the holder cover 48 and the blade cover 60. Herein, the head unit 47 is formed into an elongate shape, and is attached to the turn plate 38 so that the longitudinal direction of the head unit 47 corresponds to the longitudinal direction X of the turn plate 38. In other words, the head unit 47 has a length and a width. Each of the longitudinal direction and the width direction of the head unit 47 crosses with the axial direction of the rotation center of the rotating mechanical section 35. The longitudinal direction of the head unit 47 corresponds to the longitudinal direction X of the turn plate 38. Then, an opening 63 through which body hair is introduced to the blade 56 is formed at the head unit 47.

As shown in FIG. 7, the holder cover 48 is formed into a rectangular frame shape so that it can cover the short sides and the long sides of the turn plate 38 from the outside, and has a larger planer size than that of the turn plate 38. The holder cover 48 is provided with three openings 48*a*, 48*b*, 48*c* along its longitudinal direction. As shown in FIG. 3, the driving piece 50 is located in the center opening 48*b* of the frame in the longitudinal direction X. The length of the center opening 48*b* in the longitudinal direction X is smaller than that of the driving piece 50. Two of the supporting platforms 41, 41 are located in both sides of the driving piece 50. The supporting platforms 41, 41 are positioned in the openings 48*a*, 48*c*, respectively. Then, a driving guide 49 is provided between a location space (opening 48*b*) of the driving piece 50 and a location space (opening 48*a*, 48*c*) of each of the supporting platform 41. The driving guide 49 regulates a driving direction of the driving piece 50.

The driving guides 49, 49 limit the driving direction so that the driving piece 50 reciprocates on a straight line along the longitudinal direction X that passes through the rotation center of the face gear 31. Therefore, when receiving the driving force of the drive unit 20 (which is converted into an eccentric rotation by the eccentric section 31*b*), the driving piece 50 reciprocates along the longitudinal direction X.

As shown in FIG. 10, the holder 51 is attached in the frame of the holder cover 48. The holder cover 48 is supported by the turn plate 38 through the holder 51, and a surface of the holder cover 48 positioned in the side of the turn plate 38 contacts with projections 44, 44 located at the second plate surface of the turn plate 38. The projections 44, 44 support the holder cover 48 of the head unit 47 from the side of a second long side 38*b*, when the head unit 47 is attached to the turn plate 38. Therefore, a load (a pressure) applied from the head unit 47 to the turn plate 38 is dispersed on the supporting platforms 41, 41 and the projections 44, 44.

As shown in FIG. 3, the holder 51 includes a holder member 52 holding the blade 56, and holder pieces 53, 53. The holder piece 53 is attached to the holder member 52 so as to form a groove portion 54, into which the inclined plate 43 being inserted, between the holder piece 53 and the holder member 52.

Figure 12:
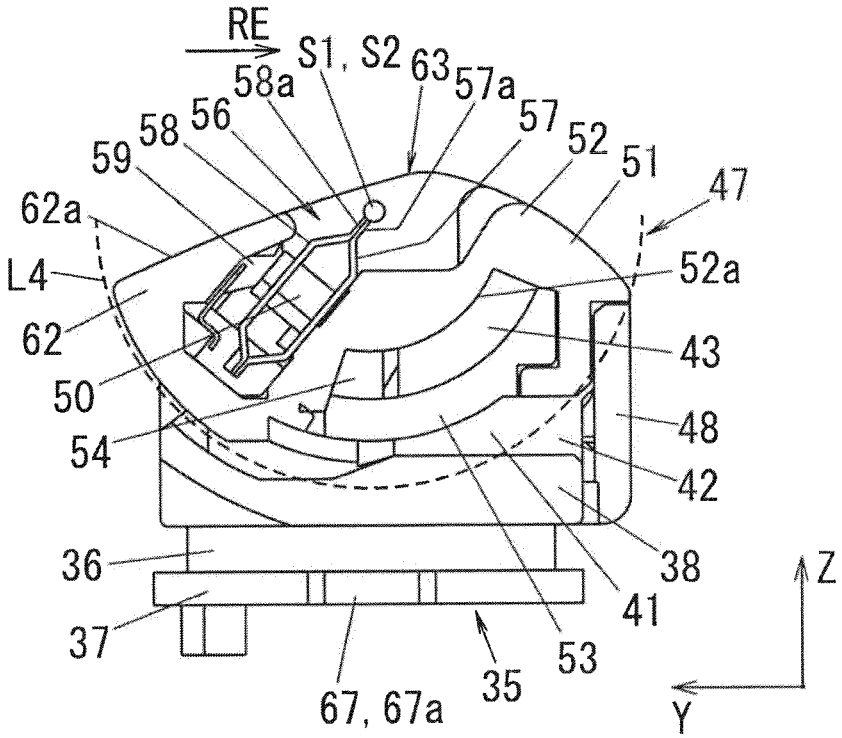
FIG. 12 shows an explanation view of the swinging mechanical section in the hair remover according to the Embodiment of the present invention when the head unit is in a natural state.
Figure 12:
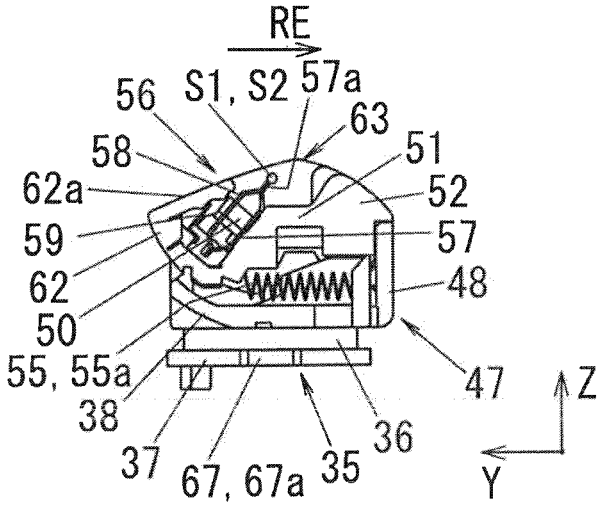

In the longitudinal direction X, the holder member 52 has a longer size than the turn plate 38. The holder cover 48 is attached to the holder member 52. The holder member 52 is provided with a protrusion portion 52*a* formed so as to be corresponding to the surface shape of the inclined plate 43 at its one surface (turn plate 38 side surface; lower surface in FIG. 12A). The protrusion portion 52*a* of the holder member 52 is placed on the inclined plates 43, 43 so that the surface of the protrusion portion 52*a* contacts with the inclined plates 43, 43. As a result, the head unit 47 is configured to swing along the inclined surfaces of the inclined plates 43, 43. As shown in FIGS. 10 and 12, the holder pieces 53, 53 are attached to both ends of the holder member 52 in the longitudinal direction X, respectively. Then, the groove portion 54 sagging in the longitudinal direction X is provided between the holder member 52 and each the holder piece 53 in the thickness direction Z. The size of the groove portion 54 in the thickness direction Z is formed so as to be slightly larger than that of the inclined plate 43.

When viewed from the width direction Y, each the groove portion 54 is formed into an arc shape having the same radius with that of the inclined plate 43. A part of the inclined plate 43 projecting from the base portion 42 in the longitudinal direction X is inserted to the groove portion 54. As shown in FIG. 12A, the length of the arc of the groove portion 54 in a circumferential direction is longer than that of the inclined plate 43. A difference between these lengths determines a swing range of the head unit 47. In the present embodiment, the inclined plate 43 is sandwiched by the holder piece 53 and the holder member 52 in the thickness direction Z. For this configuration, the head unit 47 (the holder 51) is retained to the turn plate 38 (supporting platform 41).

Then, as shown in FIGS. 7 and 12B, elastic bodies 55, 55 are provided between the holder 51 and the turn plate 38, and elastically applies energy to the head unit 47 along the width direction Y. Note that, the turn plate 38 is provided with recesses 38*c*, 38*c* sagging into the width direction Y. The elastic body 55 is arranged in the recess 38*c*. A swinging mechanical section is mainly composed of: the elastic bodies 55, 55; the supporting platforms 41, 41 each having the inclined plate 43; the holder 51; and the driving guides 49, 49 projecting.

Figure 13:
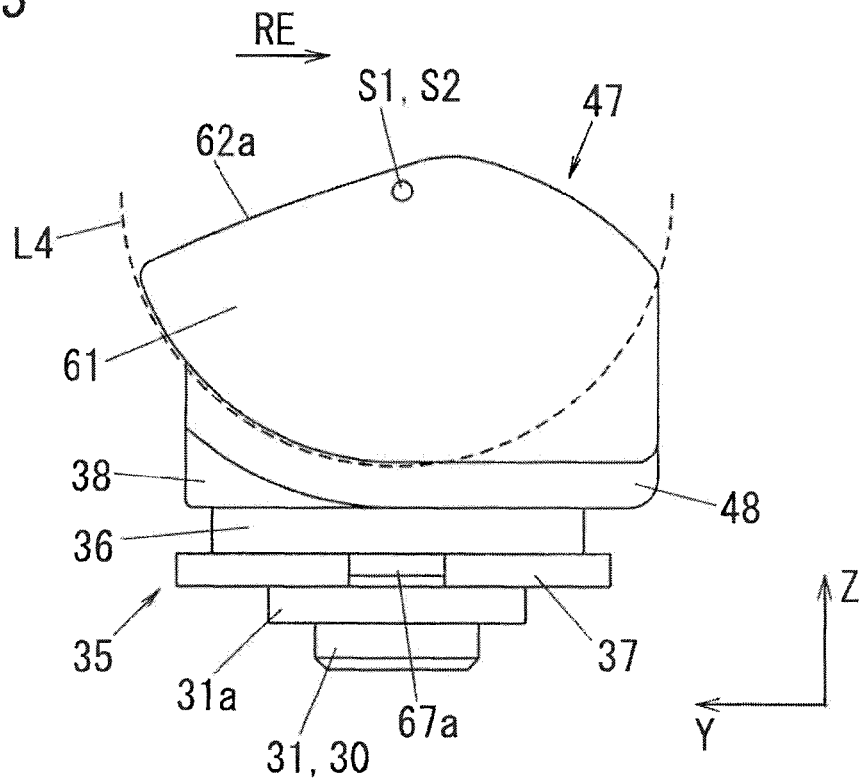
FIG. 13 shows an explanation view of the swinging mechanical section in the hair remover of the Embodiment of the present invention.
Figure 13:
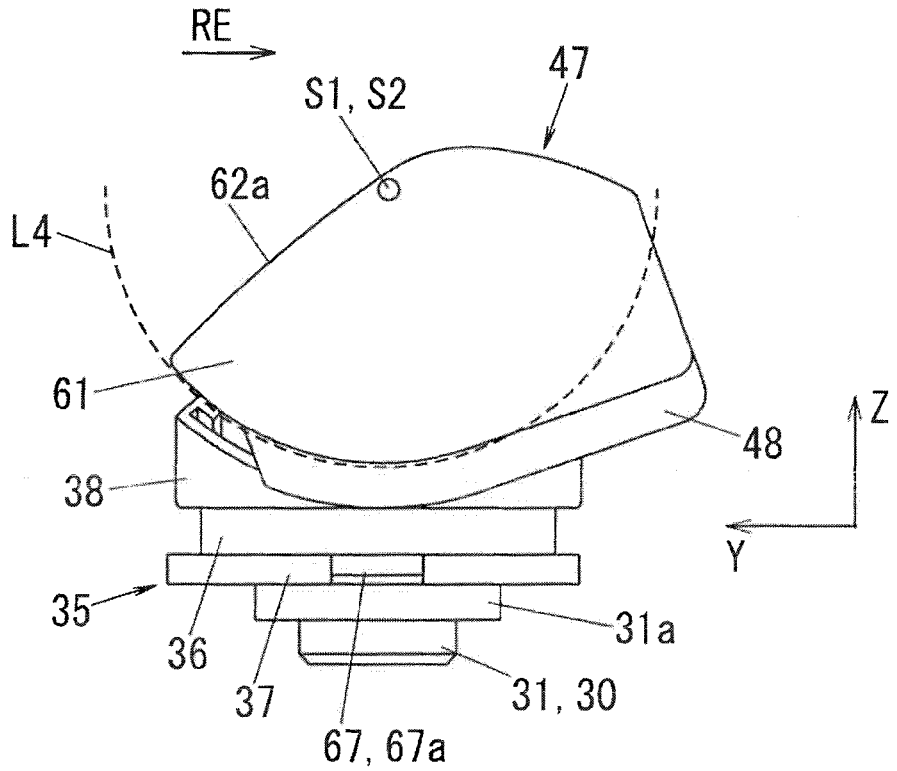

That is, as shown in FIG. 13, in the hair remover of the present embodiment, the swinging mechanical section is located between the head unit 47 and the turn plate 38. Besides, the head unit 47 is supported by the extension portion 15 through the rotating mechanical section 35. For this reason, the head unit 47 retains a swingable state through the swinging mechanical section, and furthermore can rotate with respect to the extension portion 15 through the rotating mechanical section 35.

As shown in FIG. 3, the recess 38*c* is formed near the side of the output hole 40 with respect to the supporting platform 41. Each the elastic body 55 is therefore located near the side of the output hole 40 with respect to the supporting platform 41. The elastic body 55 is composed of an urging spring 55*a* for the swing. In the present embodiment, the elastic body 55 is composed of a coil spring. As shown in FIG. 12B, each the elastic body 55 elastically applies energy to the head unit 47 in a direction from the first long side 38*a* to the opposite second long side 38*b* (along the width direction Y).

For this reason, as shown in FIG. 13, the head unit 47 is configured to elastically swing while being biased to the side of the second long side 38*b* by the elastic bodies 55, 55. Then, because the head unit 47 is biased to the side of the second long side 38*b* on the turn plate 38, one end of each the inclined plate 43 (positioned in the side of the first long side 38*a* (right end of the inclined plate 43 in FIG. 12)) is to contact with one end of the arc-shaped groove portion 54, as shown in FIG. 12A. Thereafter in the present embodiment, such a state is called as a "natural state" of the head unit 47 in which the head unit 47 is not swinging. Hereinafter, unless otherwise noted, the present embodiment is explained in the state where the head unit 47 is in the natural state as shown in FIG. 13A.

As shown in FIG. 3, the blade 56 comprises a plate-like fixed blade 57 having a comb-shaped blade (cutting teeth 57*a*) located on a straight line along the longitudinal direction X, and a plate-like movable blade 58 having a comb-shaped blade (cutting teeth 58*a*) located on a straight line along the longitudinal direction X. Then, as shown in FIGS. 11 and 12, the blade 56 is located at the side of the second long side 38*b* with respect to the rotation center of the output member 30 so that a tip of its blade (culling teeth 56*a*) faces to the side of the first long side 38*a*.

The fixed blade 57 is fixed to the holder member 52. Then, in the present embodiment, a straight line (a straight line along the tips of the blade) on which the cutting teeth 57*a* of the fixed blade 57 being arranged corresponds to the shaft center S2 of the swing of the head unit 47. For this reason, the present embodiment is configured so that, when head unit 47 swings, the projecting amount of the tip of the fixed blade 57 from the turn plate 38 in the thickness direction Z and the position of the tip of the fixed blade 57 in the width direction Y are not substantially changed.

The movable blade 58 is located along the fixed blade 57 so that the cutting teeth 58*a* overlap with the cutting teeth 57*a* of the fixed blade 57 (see FIG. 12). The movable blade 58 is elastically biased to the side of the fixed blade 57 through the force spring 59. Then, the movable blade 58 is configured to receive the driving force from the driving piece 50, and reciprocates with respect to the fixed blade 57 along the longitudinal direction X in association with the reciprocating of the driving piece 50.

In this way, the blade 56 is configured to shear (cut) body hair while inserting the hair between the cutting teeth 57*a* in the fixed blade 57 and the reciprocating cutting teeth 58*a* in the movable blade 58. That is, the blade 56 for removing hair is so-called a trimmer blade. Then, because the cutting teeth 56*a* (57*a*, 58*a*) are arranged along the longitudinal direction X, the hair remover has a "cutting width" along the longitudinal direction X (longitudinal direction X of the head unit 47), in a region for shearing the hair.

Furthermore, the head unit 47 is configured to introduce hair into the blade 56 and to shear the hair, by means of moving the head unit 47 in a direction from the second long side 38*b* to the first long side 38*a* along the width direction Y while contacting its skin contact surface (explained thereafter) with a biological surface. Hereinafter, the direction from the second long side 38*b* to the first long side 38*a* along the width direction Y will be described as a "hair removing direction RE", and the side of the first long side 38*a* will be described as a "front", and the side of the second long side 38*b* will be described as a "rearward". That is, for instance, in the hair removing direction RE, the blade 56 has the blade edge in its front, and the elastic body 55 (urging spring 55*a*) biases the head unit 47 rearward.

As shown in FIG. 11, the blade cover 60 has: a blade cover section 62 that covers the blade 56 from the side of the movable blade 58 (that is, from the rearward in the hair removing direction RE); and a side cover section 61 that covers both ends of the holder cover 48, both ends of the holder 51, and both ends of the blade 56, in the longitudinal direction X. The side cover section 61 is integrally formed in both ends of the blade cover section 62 in the longitudinal direction X, and is secured to the holder cover 48 and the holder 51.

The blade cover section 62 is formed at the side of the first long side 38*a* with a recess sagging in the width direction Y (that is, sagging rearward in the hair removing direction RE). The recess is formed so as to have a larger size than the cutting width in the longitudinal direction X. Then, the opening 63 through which the tip of blade 56 is exposed is formed between this recess and the holder member 52. Body hair is introduced to the cutting teeth 56*a* of the blade 56 through the opening 63. Then, because the cutting teeth 56*a* (blade edge) of the blade 56 is exposed through the opening 63, the shaft center S2 (which corresponds to the blade edge of the cutting teeth 57*a*) is located within the opening 63 when viewed from the thickness direction Z.

Then, the blade cover section 62 has a flat outer surface 62*a* spreading along the longitudinal direction X. This outer surface 62*a* functions as a skin contact surface for contacting with a biological surface when removing the body hair. Then, the skin contact surface is located in the side of the second long side 38*b* with respect to the opening 63 (that is, rearward in the hair removing direction RE). In other words, the skin contact surface is located rearwardly in the hair removing direction RE than the shaft center S2 of the swing and the center of output hole 40 (the rotation center of face gear 31).

Figure 14:
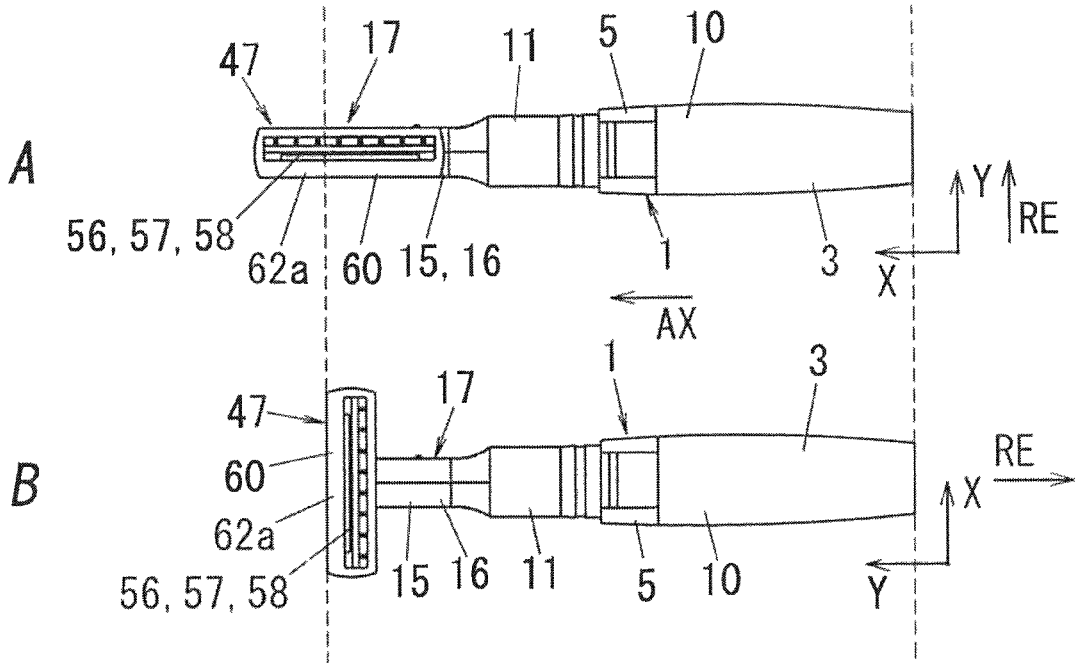
FIG. 14 shows an explanation view for explaining a length of the hair remover according to the Embodiment of the present invention.

Incidentally, in regard to the head unit 47, half of its total length in the longitudinal direction X is shorter than a distance from the rotation center of the face gear 31 to one end of the small diameter section 11. Therefore, the head unit 47 does not interfere with the small diameter section 11 when rotating. Then, as shown in FIGS. 5 and 14, the head unit 47 can be positioned so that its longitudinal direction X is substantially parallel to the extension direction Ax of the extension portion 15, and furthermore can be rotated 360 degrees. Then, the rotation center of the output member 30 is located in the output hole 40 so that its axis corresponds with the rotation center of the rotating mechanical section 35, and thereby even if the head unit 47 is located in any direction (in any rotational position), the driving force of the drive unit 20 can be transferred to the head unit 47 to drive the blade 56.

In the present embodiment, in a state where the head unit 47 is positioned so that its longitudinal direction X is substantially parallel to the extension direction Ax (see FIG. 14A), the total length of the hair remover becomes longer than other states where the longitudinal direction X of the head unit 47 crosses with the extension direction Ax such as a state where the longitudinal direction X of the head unit 47 substantially perpendicular to the extension direction Ax (see FIG. 14B).

For this reason, the rotating mechanical section 35 also functions as a variability mechanical section that can change the total length of the hair remover, by means of rotating the head unit 47 with respect to the main unit 1.

Hereinafter, a state where the longitudinal direction X of the head unit 47 is substantially parallel to the extension direction Ax, that is, a posture where the hair remover has an I-shaped appearance when viewed from the thickness direction Z (see FIG. 14A), will be described as a "first state". Also, a state where the longitudinal direction X of the head unit 47 is substantially perpendicular to the extension direction Ax of the main unit 1, that is, a posture where the hair remover has a T-shaped appearance when viewed from the thickness direction Z (see FIG. 14B), will be described as a "second state". These first and second states are defined as a standard of a state of the hair remover.

Figure 15:
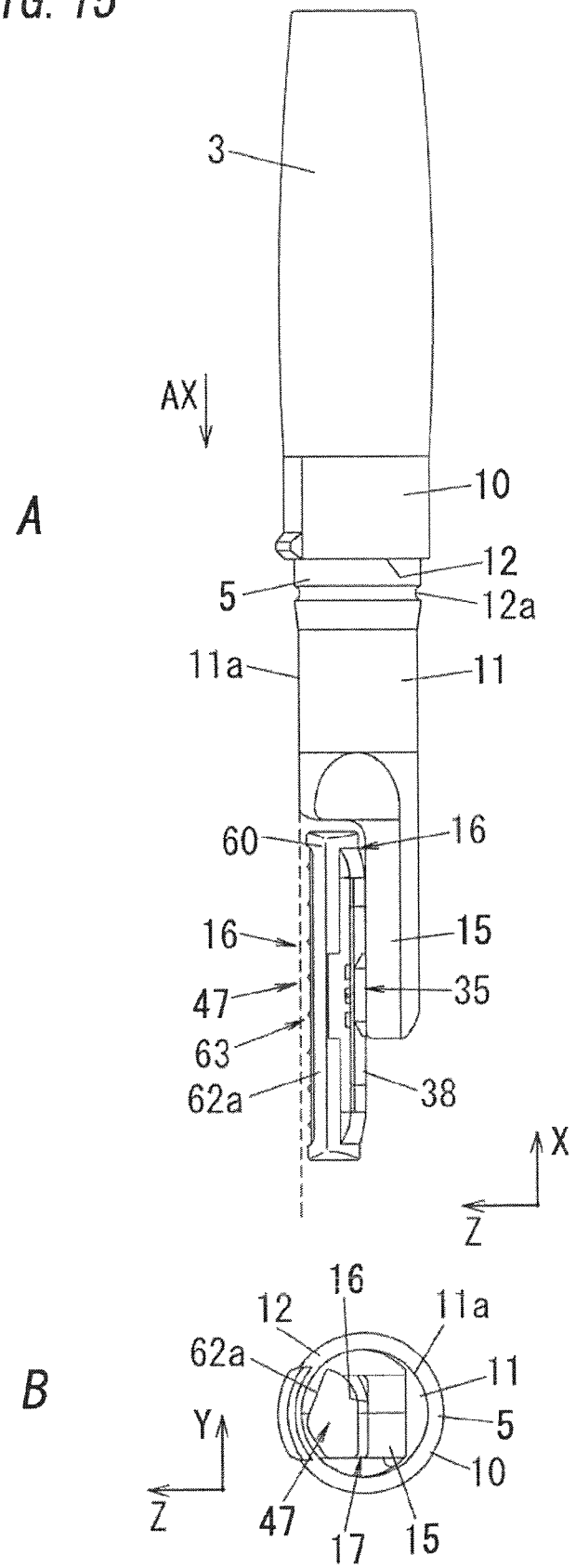
FIG. 15 shows and explanation view for explaining the relation between the main unit and the head unit.

As shown in FIG. 15, in the first state, the extension portion 15 and the head unit 47 are located so as to be substantially flush with an outer periphery 11*a* of the small diameter section 11 or so as not to extend beyond the outer periphery 11*a* when viewed from the extension direction Ax. With this configuration, the hair remover is configured so that the extension portion 15 and the head unit 47 do not project outside in a radial direction from the outer periphery 11*a*. In other words, the hair remover of the present embodiment is configured so that the outer periphery of the head unit 47 is located so as to be flush with or to be withinside the outer periphery of the main unit 1 when viewed from the extension direction Ax in the first state. Especially, the hair remover of the present embodiment is configured so that the outline of the head unit 47 is located within the outline of the main unit 1 when viewed from the extension direction Ax in the first state.

Figure 16:
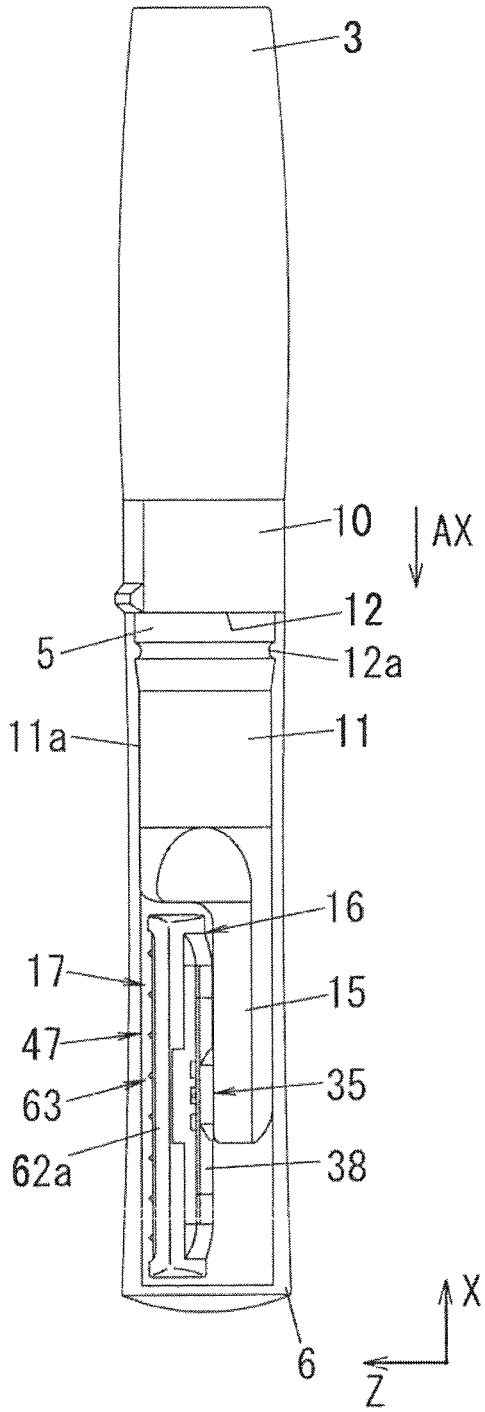
FIG. 16 shows a side view of the hair remover, in a state where a cap is attached, according to the Embodiment of the present invention, and partially includes a transparent view.

For this reason, as shown in FIG. 16, in the hair remover in the first state, the cap 6 can be attached so as to cover the extension portion 15, the head unit 47, and the outer periphery 11*a* of the small diameter section 11. This cap 6 is formed into a cylinder shape having the bottom, and a radius of its outer periphery is substantially equal to a radius of the gripper 10. The extension portion 15, the head unit 47 and the small diameter section 11 are stored in the cap 6. The cap 6 is attached to the main unit 1 so that an axis of the cap 6 substantially corresponds with an axis of the gripper 10. At this time, one end of the cap 6 in an opening side fits in the difference 12 in level provided between the small diameter section 11 and the gripper 10. The cap 6 is held to the housing 5 by means of fitting with a depression 12*a* which is provided at the main body 1 (small diameter section 11). The cap 6 is attached to the main body 1 so as not to form a step therebetween.

As shown in FIG. 6, the hair remover includes a lock mechanism that regulates a stopping position of the head unit 47 (regulates a direction of the head unit 47) when the head unit 47 is rotated through the rotating mechanical section 35. As shown in FIG. 4, the lock mechanism includes a handle member 69, a spring 68 and a recess 67 (see FIG. 7). The spring 68 is located within the extension portion 15, and elastically applies energy to the handle member 69 in a direction along the extension direction Ax so as to be separated from the main unit 1.

As shown in FIG. 7, the recess 67 is formed at the flange 37 so as to sag to the inside along the radial direction. The recess 67 is formed into a rectangular shape when viewed from the thickness direction Z. Then, in the present embodiment, three recesses 67 are provided at flange 37, and are located at intervals of 90 degrees along a circumferential direction of the rotation. More specifically, two recesses 67, 67 (first recesses 67*a*, 67*a*) are located on a straight line along the longitudinal direction X passing through the rotation center of the flange 37 so as to have own back toward each other, and one recess 67 (a second recess 67*b*) is located on a straight line along the width direction Y passing through the rotation center of the flange 37.

As shown in FIG. 6, the handle member 69 is located within the extension portion 15, and is biased toward the tip side of the extension portion 15 (toward left in FIG. 6) through the spring 68. The handle member 69 is arranged so as to be slidable in the extension direction Ax. Then, as shown in FIG. 4, the handle member 69 is provided with a stop piece 69*a* and an operation piece 69*b*. The stop piece 69*a* projects in the extension direction Ax, and selectively fits in one of the three recesses 67. The operation piece 69*b* is formed in order to cause the handle member 69 to slide to the side of the gripper 10 against the bias force of the spring 68. Then, the operation piece 69*b* is exposed to outside through an opening formed at the extension portion 15. The operation piece 69*b* is operated by a user through the exposed portion.

A projecting tip of the stop piece 69*a* is formed into a rectangular shape so as to fit in the recess 67. A rotating movement of the rotating part 36 is limited by fitting the projecting tip into the recess 67, and thereby the stopping position of the head unit 47 (the direction of the head unit 47) is regulated. When handle member 69 is slid to the side of the small diameter section 11 through operating of the operation piece 69*b* so as to extract the tip of the stop piece 69*a* from the recess 67, the rotating operation is released from the limitation.

In addition, when the stop piece 69*a* fits in one of the first recesses 67*a*, the head unit 47 is held in the first state, which is the state the cap 6 can be attached to. Also, when the stop piece 69*a* fits in the other of the first recesses 67*a*, the head unit 47 is held also in the first state. Note that, at this time, front and back of the hair removing direction RE of the head unit 47 (direction of the blade edge) switches with each other. When the stop piece 69*a* fits in the second recess 67*b*, the head unit 47 is held in the second state, and the gripper 10 is located in the front side in the hair removing direction RE.

Consequently, as described above, in the hair remover of the present embodiment, when the head unit 47 is rotated in a circumferential direction of the rotating part 36 by means of the rotating mechanical section 35, the longitudinal direction X of the head unit 47 can be changed with respect to the extension direction Ax, as shown in FIG. 14. Then, as shown in FIGS. 8 and 9, the rotating mechanical section 35 is provided with the output hole 40, of which the axis substantially corresponds with the rotation center of the output member 30, and which outputs the driving force of the drive unit 20 into the head unit 47. Therefore, even if a direction of the head unit 47 is changed, the driving force can be transferred (outputted) to the head unit 47.

For this reason, the hair removing direction RE (that is, the direction of the blade edge) can be changed with respect to the main unit 1 (the gripper 10), and the hair remover can transfer the driving force of the drive unit 20 to the head unit 47 and can perform the removing motion, regardless of the stopping position of the head unit 47. Therefore, when removing body hair growing on an area of biological surface having irregularities around, such as a base of arm or leg, the hair remover can be switched (changed) to a posture (state) where the main unit 1 (the gripper 10) or hand grasping the main unit 1 hardly interferes with the irregularities, and can perform the removing motion. Because the hair remover can be switched to a desirable position where the main unit 1 or the like hardly interferes with the irregularities when performing the removing motion, the hair remover can reduce the possibility that body hair is insufficiently shaved due to the interference. As a result, convenience of the hair remover can be improved.

Then, in the present embodiment, the rotation center of the rotating mechanical section 35 and the rotation center of the output member 30 are configured to substantially correspond with each other. Thereby, the hair remover is configured so that a relative position of the turn plate 38 and the output member 30 (relative position between the rotation center of the rotating mechanical section 35 and the rotation center of the face gear 31) are kept with each other upon rotation of the head unit 47. Therefore, basic characteristics of the driving force transferred to the head unit 47, such as amplitude (moving range) of the driving piece 50 or a rotating speed of the eccentric section 31*b*, do not change, regardless of the stopping positions of the head unit 47. As a result, the movable blade 58 can be driven stably in substantially same condition.

Then, in the present embodiment, the gear block 25, which transferring the driving force from the rotation shaft 22 to the output member 30, is shifted a position (located at some distance) from the rotation shaft 22, toward the outside along a radial direction. The output member 30 therefore can be located on an extended line of the rotation shaft 22. As a result, the hair remover is configured to have reduced amount of projection of the head unit 47 toward outside along a radial direction (of the main unit 1).

For this reason, the hair remover can reduce the amounts of the projection of the head unit 47 and the drive transmission unit 23 toward outside along a radial direction with respect to the main unit 1. Particularly, the hair remover can be configured so that the head unit 47 and the drive transmission unit 23 are not to project beyond the small diameter section 11 to the outside along the radial direction in the first state. Then, this configuration makes the hair remover have a compact configuration (that is, to be downsized). As a result, the hair remover has an improved convenience when removing hair. Also, this configuration makes it possible to prevent from increasing in the size of the cap 6. Furthermore, the downsizing of the cap 6 makes the hair remover have a compact configuration, in a state where the cap 6 is attached (that is, in a non-use state, such as a time when the hair remover is carried). Therefore, the hair remover has improved convenience in the time when the hair remover is carried.

Figure 17:
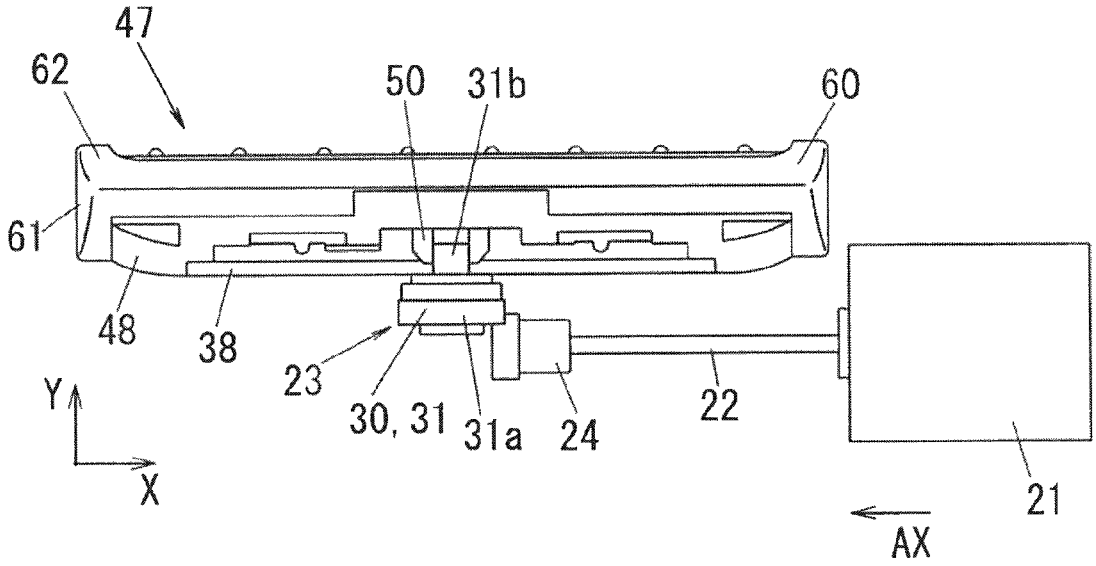
FIG. 17 shows a side view of a reference example for explaining the projecting amount of the head unit.

Then, in the present embodiment, the extension portion 15 is placed at some distance from the rotation shaft 22, toward the outside along the radial direction, and the recess 17 is provided in the rotation position of the head unit 47. Therefore, in the hair remover, a dead space around the extension portion 15 can be reduced and the projecting amount of the head unit 47 along the radial direction can be reduced, compared with a hair remover that has an extension portion 15 provided on an extended line along the rotation shaft 22 (see FIG. 17). For this reason, the hair remover can be configured so that, in the first state, the head unit 47 and the extension portion 15 are not projected beyond the small diameter section 11 toward outside along a radial direction. As a result, the hair remover can be configured to have a compact configuration.

In addition, when viewed from the extension direction Ax, the head unit 47, the extension portion 15 and the drive transmission unit 23 do not project beyond the small diameter section 11 toward outside along a radial direction in the first state. Therefore, an inner diameter of the cap 6 can be configured so as to be substantially equal to an outer diameter of the small diameter section 11. For this reason, the diameter of the cap 6 is hardly influenced by the projecting amount of the head unit 47 from the extension portion 15 and the projecting amount of the extension portion 15, along the radial direction. The size of the cap 6 therefore can be downsized. As a result, the hair remover can be configured to have a compact configuration.

Then, in the present embodiment, the rotating mechanical section 35 has the turn plate 38 that supports the head unit 47. Thereby, the swinging mechanical section configured to swing the head unit 47 with respect to the turn plate 38 can be provided between the head unit 47 and the turn plate 38. Furthermore, the swinging mechanical section can be located so as to hardly interfere with the rotating mechanical section 35. Therefore, the swing of the head unit 47 makes it easier for the blade 56 to come close to a biological surface, and the head unit 47 contacts with the biological surface more smoothly, and then hair can be introduced into the blade 56 more easily.

Then, because the swinging mechanical section is configured to swing the head unit 47 around an imaginary shaft center S2, there is no need to have a shaft center really existing shaft member. Therefore, the hair remover can avoid the possibility that a size of the head unit 47 becomes larger, because the imaginary shaft center S2 never interfere with other configuration members of the head unit 47. Furthermore, the hair remover can have a larger swingable radius, compared with a hair remover having such a really existing shaft member.

In addition, in the present embodiment, the tips (blade edges) of the fixed blade 57 are located on the shaft center S2. Therefore, when the head unit 47 is swinging, the position of the tip (blade edge) of the fixed blade 57 does not move. Then, a distance from the biological surface to the tip of the blade (that is, a length of a hair introduced in the blade 56) is not substantially changed regardless of the swinging state of the head unit 47. For this reason, this configuration can maintain the shaving performance, such as a cutting height which being influenced by a distance from the biological surface to the tip of the blade, regardless of the swinging position of the head unit 47. In other words, the hair remover having the stable shaving performance can be provided.

Furthermore, in the present embodiment, the skin contact surface is provided rearwardly (in the hair removing direction RE) than the tip of the blade 56. As a result, when the skin contact surface is pressed against the biological surface upon removing hair, the head unit 47 swings and easily follows the skin. This makes it easier for the blade 56 to come closely contact to the skin, and then hair can be cut in a location near the biological surface. In other words, the hair remover having improved shaving performance can be provided.

Then, in the present embodiment, the rotating mechanical section 35 also functions as the variability mechanical section. Therefore, the total length of the hair remover in the extension direction Ax can be changed through switching from the first state to the second state or the like in accordance with an area or its shape of a biological surface in which the hair removing is desired. Therefore, when removing hair, the hair remover or a hand grasping it can be hardly interfered with the irregularities by selecting a desired state of the hair remover. Then, the hair remover can reduce the possibility that body hair is insufficiently shaved due to the interference.

The present invention is not limited to the configuration described above, and numerous modifications and variations can be made by those skilled in the art without departing from the true spirit and scope of this invention. For instance, the base portion 42 may be formed so as to have the same length in the longitudinal direction X as the inclined plate 43, and a second groove portion may be formed between those in the thickness direction Z. In this configuration, the holder piece 53 may be inserted into the second groove portion, and thereby the holder 51 can be retained to the turn plate 38. Further, for instance, the hair remover may comprise a cord or the like for connecting to a commercial power source. Also, the gear block 25 may be composed of a plurality of spur gears, or may use a caterpillar tread such as a belt instead of using the transmission shaft 26.

The invention claimed is:

1. A hair remover comprising:

a main unit having a gripper;

a head unit having a movable blade and a fixed blade for removing body hair; and a drive unit comprising a motor and configured to transfer a rotational driving force of said motor to drive said movable blade, wherein said main unit is provided in one end thereof, with an extension portion, each of said main unit and said extension portion having a longitudinal axis that are parallel with each other, said extension portion being offset with regards to the longitudinal axis of said main unit to define a recess which houses said head unit, wherein said extension portion is provided with a rotating mechanical section that rotatably supports said head unit with respect to said main unit around an axis of the rotating mechanical section that is perpendicular to the longitudinal axis of said extension portion, wherein said head unit is rectangular defining a longitudinal dimension and a width dimension that each extend perpendicularly to of the axis of said rotating mechanical section, said rotating mechanical section supporting said head unit so that the head unit is switchable between a first state where the longitudinal dimension of said head unit is parallel to the longitudinal axis of said extension portion and a second state where the longitudinal dimension of said head unit is perpendicular to the longitudinal axis of said extension portion, and wherein said head unit is arranged in the recess so that an outer periphery of said head unit in the first state is flush with an outer periphery of said main unit or is located within the outer periphery of said main unit when viewed from the longitudinal axis of said extension portion.

2. The hair remover as set forth in claim 1, wherein the drive unit is configured to drive the movable blade when the head unit is in the first state and when the head unit is in the second state.

3. The hair remover as set forth in claim 1, wherein said motor is located in said main unit and has a rotation shaft defining an axis of rotation, wherein said extension portion is offset with regards to the axis of rotation.

4. The hair remover as set forth in claim 1, wherein said motor is located in said main unit and has a rotation shaft defining an axis of rotation that is parallel to the longitudinal axis of said main unit, wherein said drive unit further comprises:

an output member disposed in the extension portion and configured to output the rotational driving force of said motor to said movable blade; and a transmission member configured to transfer the rotational driving force of said motor to said movable blade, and wherein said transmission member is housed in said extension portion, whereby the transmission member is offset with regards to said rotation shaft of said motor.

5. The hair remover as set forth in claim 4, wherein said extension portion is offset with regards to the axis of rotation of said rotation shaft.

6. The hair remover as set forth in claim 4, wherein said transmission member comprises a transmission shaft arranged parallel to the longitudinal axis of said extension portion.

* * * * *